US009458686B2

(12) United States Patent
Sherman

(10) Patent No.: US 9,458,686 B2
(45) Date of Patent: Oct. 4, 2016

(54) FRACTURING TOOL ANCHOR

(75) Inventor: Scott Sherman, Blackie (CA)

(73) Assignee: Trican Well Service Ltd., Calgary, CA (US)

( * ) Notice: Subject to any disclaimer, the term of this patent is extended or adjusted under 35 U.S.C. 154(b) by 218 days.

(21) Appl. No.: 13/569,556

(22) Filed: Aug. 8, 2012

(65) Prior Publication Data

US 2013/0206392 A1 Aug. 15, 2013

(30) Foreign Application Priority Data

Aug. 8, 2011 (CA) ..... 2748609

(51) Int. Cl.

| | |
|---|---|
| ***E21B 23/01*** | (2006.01) |
| ***E21B 33/1295*** | (2006.01) |
| ***E21B 33/129*** | (2006.01) |
| *E21B 43/26* | (2006.01) |

(52) U.S. Cl.

CPC ..... *E21B 23/01* (2013.01); *E21B 33/129* (2013.01); *E21B 33/1295* (2013.01); *E21B 43/26* (2013.01)

(58) Field of Classification Search

CPC ..... E21B 33/1295; E21B 33/1293; E21B 33/1291; E21B 23/01; E21B 23/006

USPC ..... 166/206, 215, 217, 214, 212

See application file for complete search history.

(56) References Cited

U.S. PATENT DOCUMENTS

| | | | | | |
|---|---|---|---|---|---|
| 2,743,781 | A * | 5/1956 | Lane | | 166/212 |
| 2,792,063 | A * | 5/1957 | Jones | | 166/212 |
| 3,463,229 | A * | 8/1969 | Hinkle | | 166/207 |
| 3,705,624 | A * | 12/1972 | Pitts | | 166/216 |
| 3,743,016 | A * | 7/1973 | Crow | E21B 23/04 | 166/114 |
| 4,610,300 | A * | 9/1986 | Mullins et al. | | 166/134 |
| 5,070,941 | A * | 12/1991 | Kilgore | | 166/98 |
| 5,131,468 | A * | 7/1992 | Lane et al. | | 166/120 |
| 5,148,866 | A * | 9/1992 | Greenlee | | 166/134 |
| 5,531,280 | A * | 7/1996 | Steinkamp et al. | | 175/230 |
| 2009/0145614 | A1* | 6/2009 | Cook et al. | | 166/387 |
| 2011/0146970 | A1* | 6/2011 | Hallundbaek et al. | | 166/212 |

FOREIGN PATENT DOCUMENTS

RU 92 084 U1 3/2010

* cited by examiner

*Primary Examiner* — Nicole Coy
*Assistant Examiner* — Tara Schimpf
(74) *Attorney, Agent, or Firm* — Dunlap Codding, P.C.

(57) ABSTRACT

The present invention is directed to a fracturing tool anchor adapted for use with a work string in a wellbore. In one embodiment, the anchor has a housing with a central passage and an uphole and downhole end. The housing has a plurality of ports positioned circumferentially around the housing and along the length of the housing. The ports each contain an engagement member, such as a piston, and a return spring. The engagement member is adapted to extend radially outward when the anchor is pressure activated, to engage the wall of the casing or wellbore. The present application is also directed to a fracturing tool anchor that does not need to be pressure activated and utilizes slips as the engagement members.

10 Claims, 7 Drawing Sheets

FRACTURING TOOL ANCHOR

CROSS REFERENCE TO RELATED APPLICATIONS

This application claims priority from Canadian Patent Application No. 2,748,609, filed Aug. 8, 2011, which is hereby incorporated by reference herein in its entirety.

BACKGROUND OF THE INVENTION

1. Field of the Invention

The present invention relates generally to a downhole tool for use in oil field applications. In particular, this invention relates to an anchor for use with a work string, such as coiled tubing, in a wellbore, such as a horizontal wellbore.

2. Brief Description of Related Art

In recent years there has been a large increase in the number of wells that have been drilled with horizontal portions. When servicing or completing these kinds of wells it is common to use coiled tubing to convey the tools or instruments to the portion of the wellbore of interest, owing to its flexibility and speed of deployment compared to other methods. Compared to traditional drill pipe, coiled tubing is quite thin walled, and subject to buckling if a large compressive force is applied to it.

If the bottom sealing elements on a selective frac packer fail, a net upward force is generated due to the pressure contained between the upper sealing device(s) and the toe of the well. This upward force can result in the coiled tubing buckling under the compressive loading. The upward force can be mitigated in wells comprised of 4.5 inch casing or smaller, however in wells with 5.5 inch casing or larger the hydraulic forces can easily exceed 200,000 psi. In order to prevent buckling of the coiled tubing, it is necessary to provide a device that can transmit the upward compressive force in the event of a seal failure away from the coiled tubing and to the casing and thereby to the earth, rather than allowing the coiled tubing to be subjected to the compressive force.

SUMMARY OF THE INVENTION

In a first aspect of the present invention there is provided a fracturing tool anchor adapted for use in a wellbore, the fracturing tool anchor comprising:

an housing having an uphole and a downhole end;

the housing having a central passage between the uphole and downhole ends;

a plurality of engagement members positioned between the uphole and downhole ends;

the engagement members adapted to extend radially outwards to engage a casing or wellbore wall;

wherein, upon setting, the engagement members extend radially outwards to engage the casing or wellbore wall.

In one embodiment of the present invention, the engagement members are pistons located in ports, positioned circumferentially around the housing and along the length of the housing. The anchor is pressure activated in order to engage the wall of the casing or wellbore.

In another aspect of the present invention, there is provided a fracturing tool anchor that does not need to be pressure activated and utilizes slips as the engagement members.

BRIEF DESCRIPTION OF THE DRAWINGS

The embodiments of the present invention are described below with reference to the accompanying drawings in which.

DETAILED DESCRIPTION OF EXEMPLARY EMBODIMENTS

Figure 1:
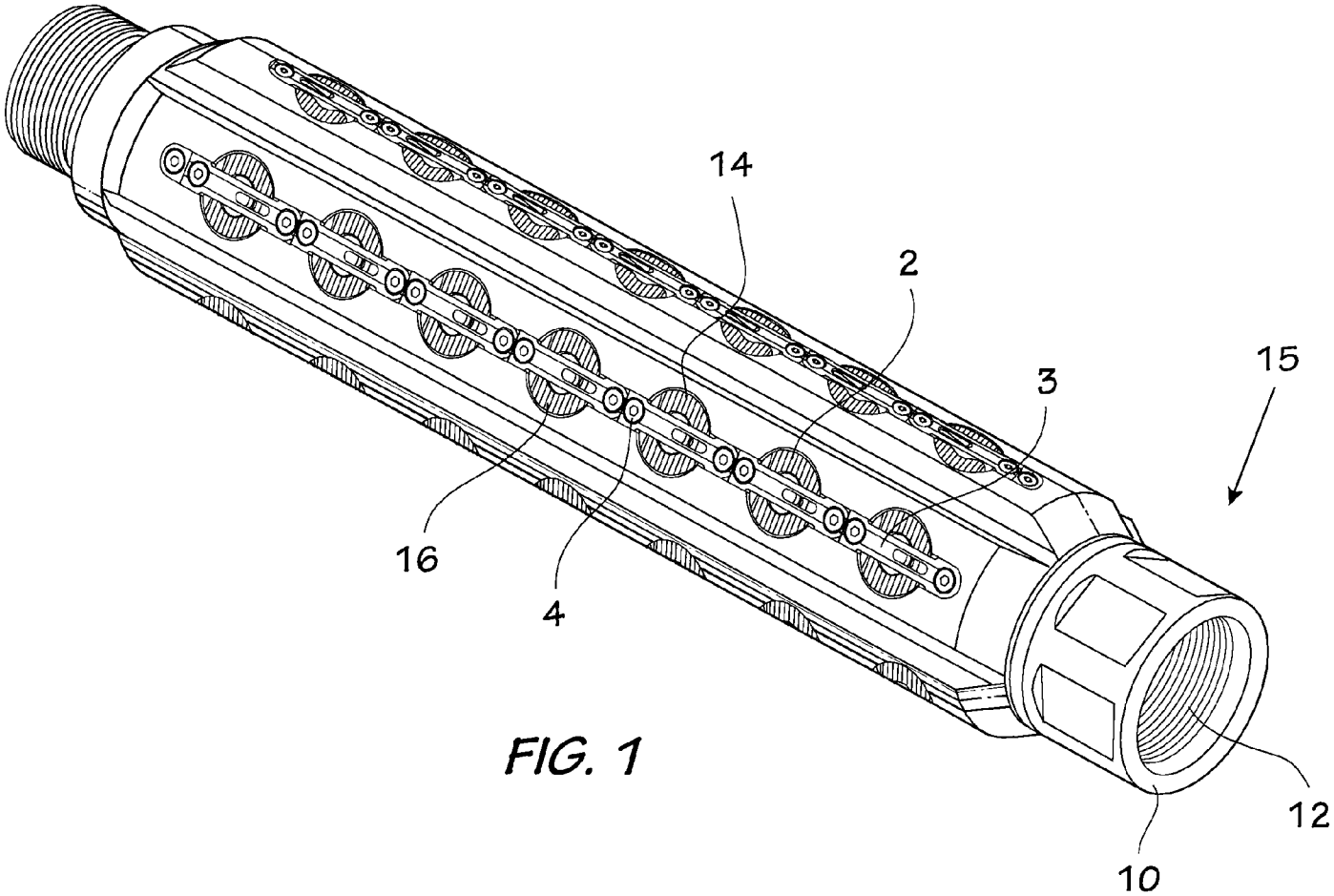
FIG. 1 is a perspective view of an anchor embodying the invention.
Figure 2:
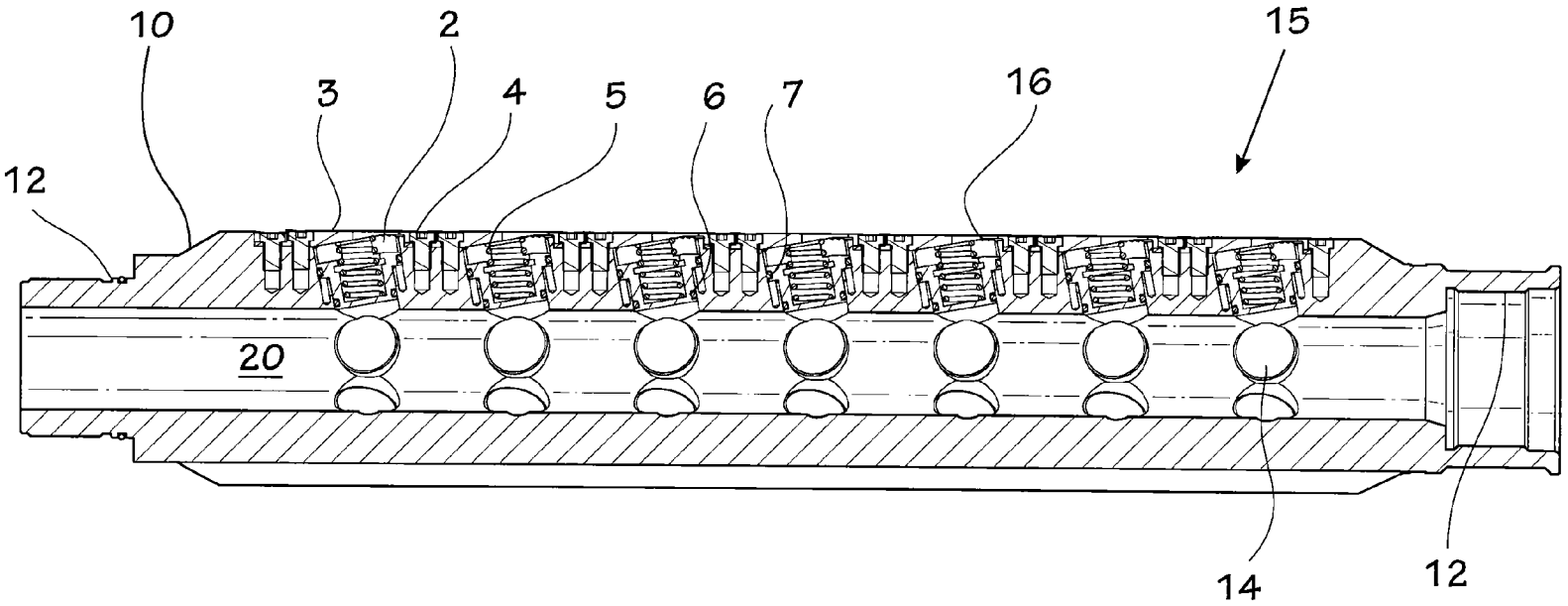
FIG. 2(*a*) is a cross-section of an anchor embodying the invention, FIG. 2(*b*) is a magnified view of the same cross-section, FIG. 2(*c*) illustrates the anchor of FIG. 2(*b*) with the pistons in an extended, radially outward position, and FIG. 2(*d*) illustrates a plan view of a port of FIG. 2(*a*) with the piston removed.
Figure 2:
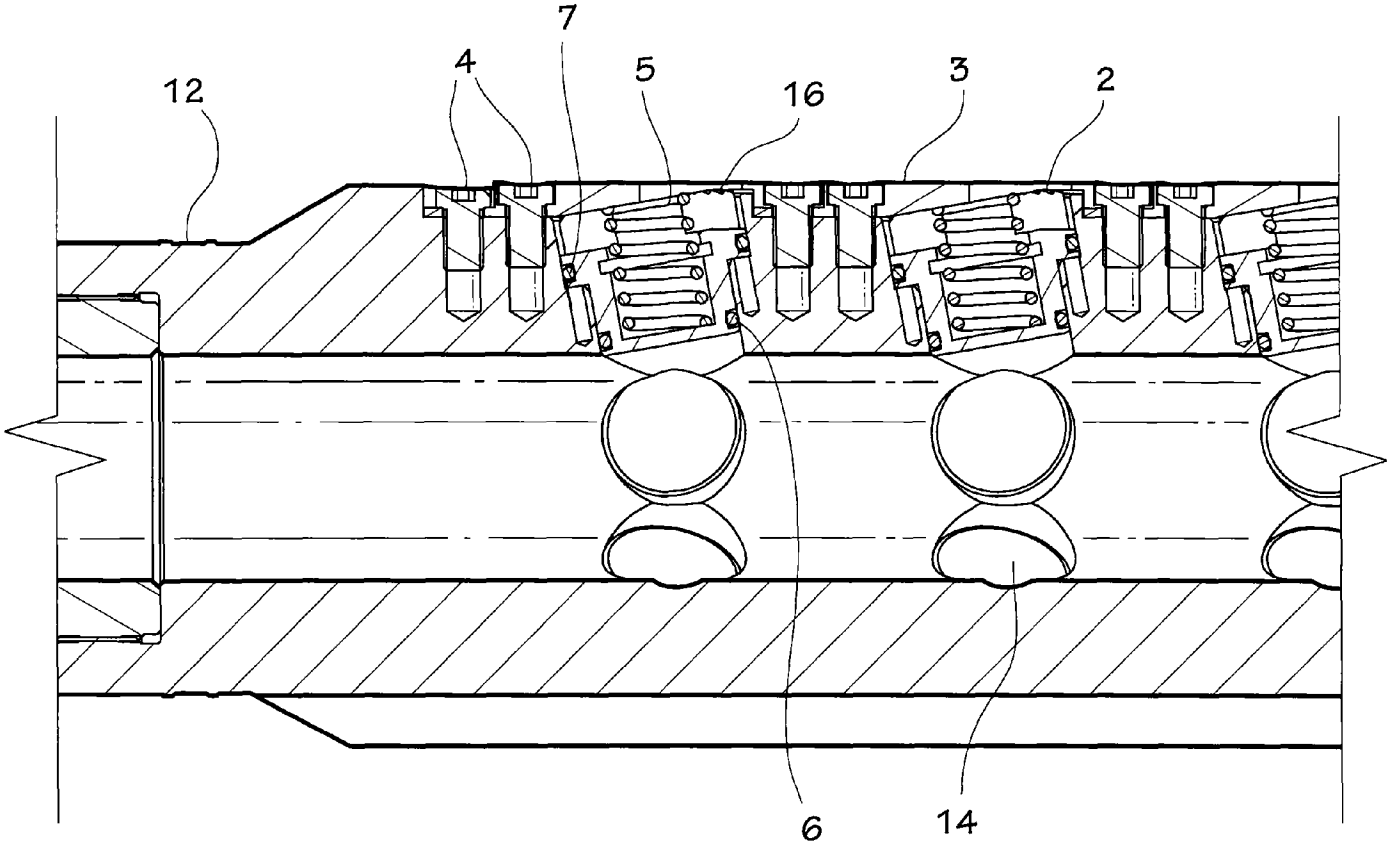
Figure 2C:
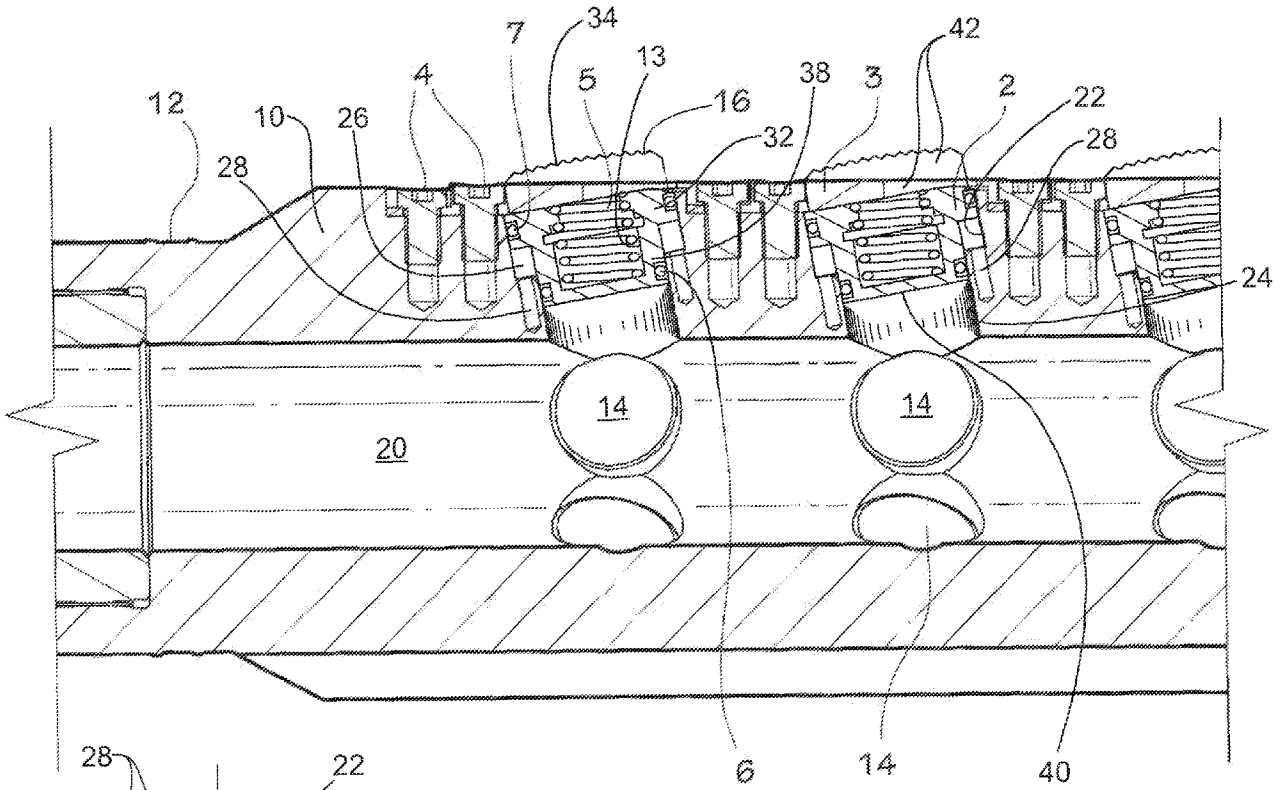
Figure 2D:
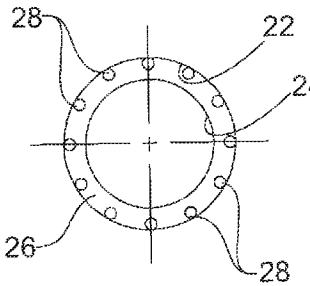

As shown in FIGS. 1, 2(*a*), 2(*b*), 4, 5(*a*), and 5(*b*), a fracturing tool anchor 15 consists of a housing 10, which may be cylindrical in shape. The housing 10 has an uphole and downhole end. Positioned on the ends are threads 12 for attaching the anchor 15 to a work string, which may be coiled tubing, jointed pipe or any other suitable material. The threads 12 may also be used for attaching other tools to the anchor 15. In the illustrated embodiment, the threads are 2.750-10 Stub Acme threads.

In the embodiment illustrated in FIGS. 1 and 2*a*, the fracturing tool anchor 15 has a plurality of ports 14 positioned circumferentially around the housing 10. The ports 14, in the illustrated embodiment, are also spaced longitudinally along the housing 10 between the downhole and uphole ends. Within each port 14 is an engagement member, which is preferably a piston 2. Also located in each port 14 is a return spring 5. The piston port and the engagement members therein are angled toward the uphole direction of the anchor 15 to provide stronger engagement between the piston face and the wellbore or casing when an upward force is applied to the anchor 15. The engagement members or pistons 2 are in fluid communication with a central passage 20 of the housing 10 such that the application of pressure to the central passage 20 causes the pistons 2 to extend radially outwards to engage the wall of the wellbore or casing.

Covering the piston 2 to ensure that its range of travel does not exceed the bore in the housing is a spring retainer 3. Spring retainer 3 is secured to the housing 10 with a pair of cap screws 4. The return spring 5 resides in a pocket 13 in the piston 2 and is fit between the string retainer 3 and the piston 2. Piston 2 is sealingly engaged with the bore machined in housing 10 by O-rings 6 and 7. In the illustrated embodiment, the O-rings 6 and 7 are highly-saturated nitrile 80 durometer O-rings.

With reference to FIG. 1, the outward facing surface of piston 2 is serrated 16 to firmly engage the wall of the wellbore, or casing, and prevent relative movement between the anchor 15 and the earth. In this manner, any upward forces originating from downhole of the anchor 15 can be transmitted to the earth, rather than to the work string uphole of the anchor 15, thus ensuring no excessive loads are imposed upon the work string.

As shown in FIGS. 2(*b*) and 2(*c*), each port 14 can be counterbored and the respective pistons can be cooperatively stepped. The counterbored port has a large diameter bore 22 adjacent the wellbore or casing and a small diameter bore 24 adjacent the central bore 20. An annular shoulder 26 is formed between the large and smaller diameter bores 22, 24. As shown in the port of FIG. 2(*d*), a plurality of holes 28 are provided in the housing 10 about the annular shoulder 26.

As shown in FIGS. 1 and 2(*c*), the piston 2 has a large diameter portion 32 with an outward facing surface 34 adjacent the wellbore or casing. The outward facing surface 34 is fit with serrations 16. The piston's large diameter portion 32 is fit to the large diameter bore 22. The piston has a small diameter portion 38 with an inward facing surface 40 adjacent the central bore 20 and fit to the small diameter bore 24. The outward facing surface 34 also fit with a longitudinal slot 42. As shown in FIG. 1, the retainer 3 extends longitudinally along the housing across the piston 2 and aligns with the longitudinal slot 42.

When the work string is positioned in the hole at the desired location, the anchor 15 is set by applying pressure to the central passage 20 of the anchor 15 and the pistons 2 are biased radially outward (FIG. 2(*c*)), wherein the serrated faces engage the casing or wellbore wall. When it is desired to remove the work string from the hole, the pressure is reduced in the central passage 20, and the springs 5 return the pistons 2 to their rest position and the anchor can be removed from the hole. It may be necessary to move the work string up or down in the hole to release the "bite" the serrated face of the pistons 2 have on the casing, and then the spring 5 can return the pistons to their retracted position.

Figure 3:
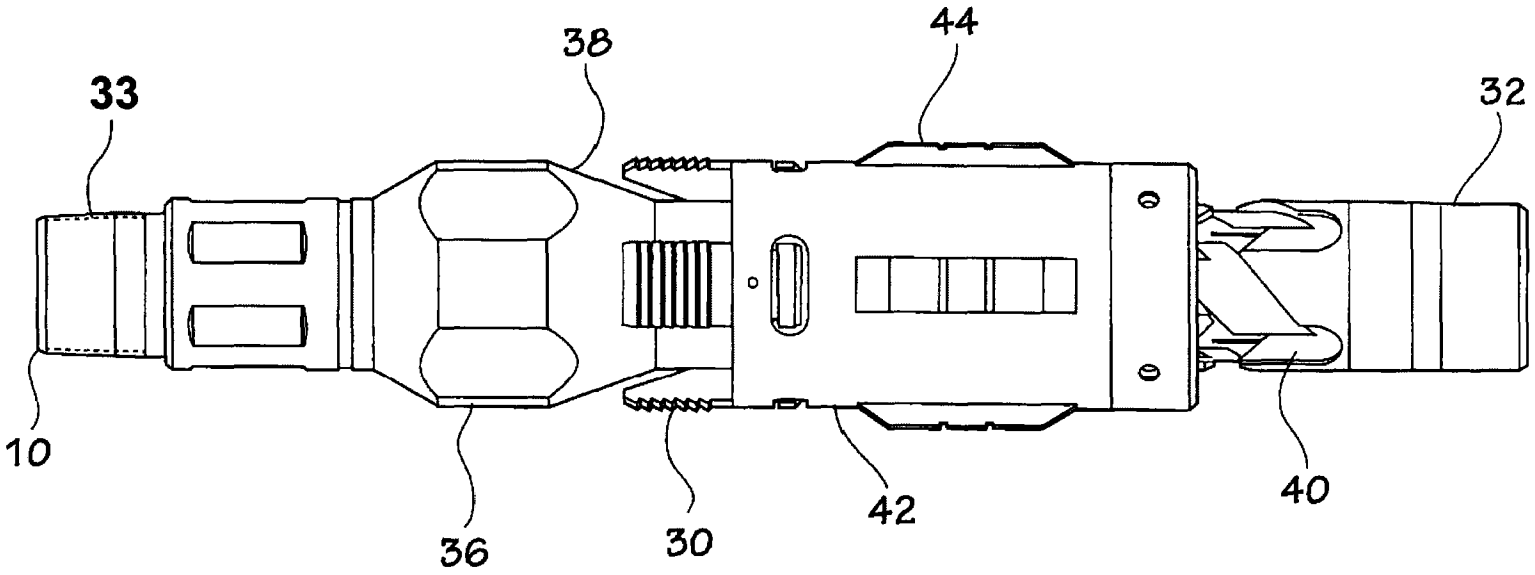
FIG. 3 is an elevational view of another embodiment of the invention.
Figure 4:
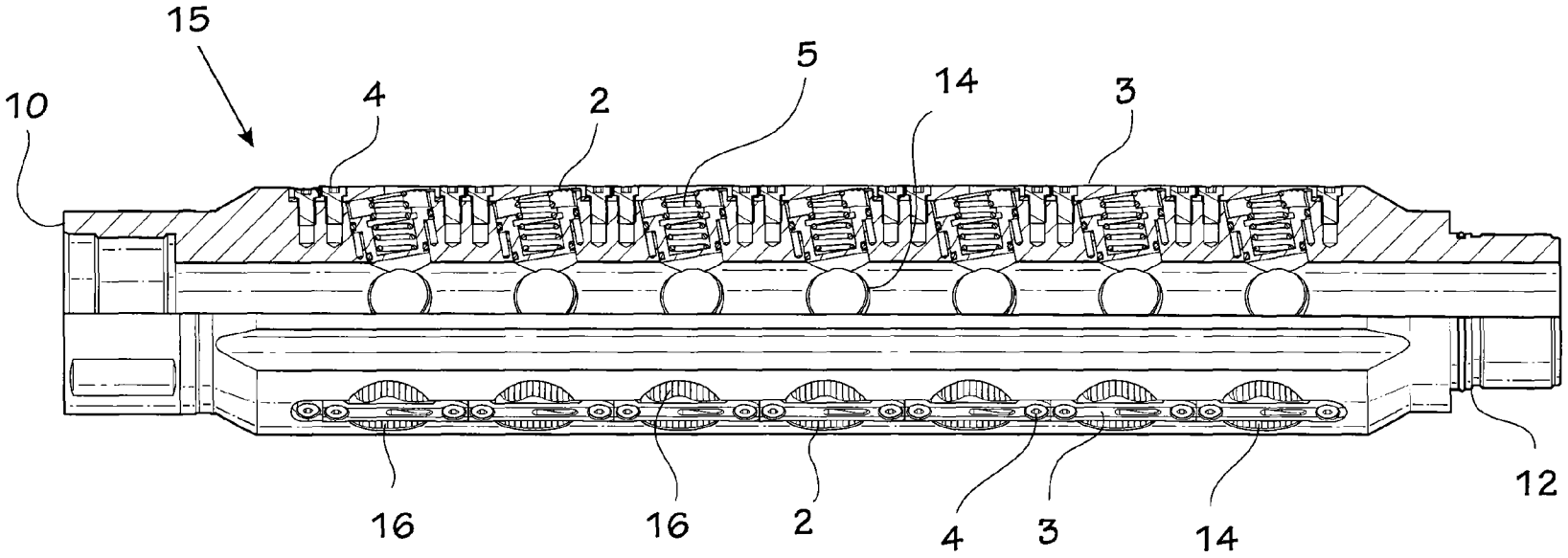
FIG. 4 is a three-quarter view of the embodiment of the anchor illustrated in FIGS. 1, 2(*a*), and 2(*b*), wherein the top-half of the figures illustrated a cross-section of the anchor (as illustrated in FIGS. 2(*a*) and 2(*b*)), while the bottom-half illustrates the bottom half of the anchor.
Figure 5:
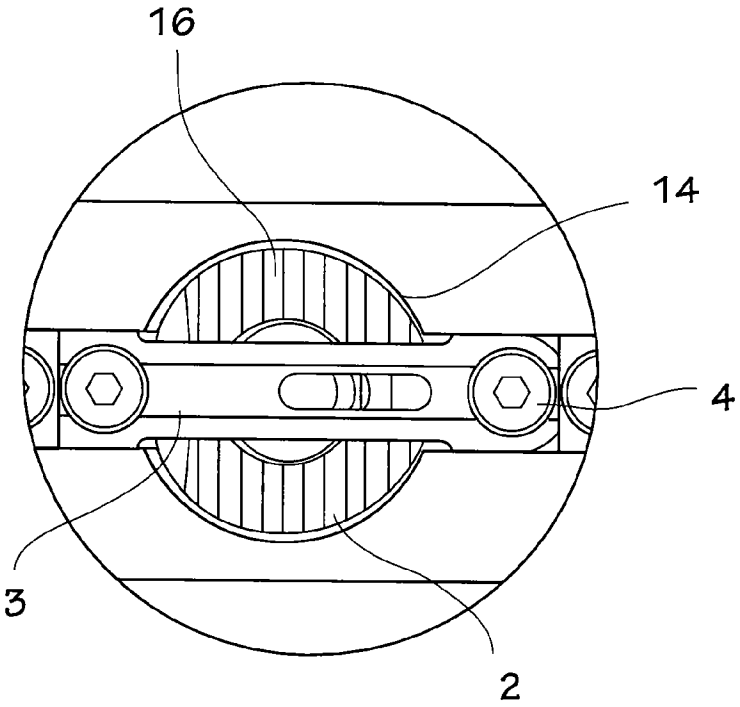
FIGS. 5(*a*) and 5(*b*) illustrate the serrated edge of the piston of the embodiment illustrated in FIGS. 1, 2(*a*), 2(*b*), and 4.
Figure 5:
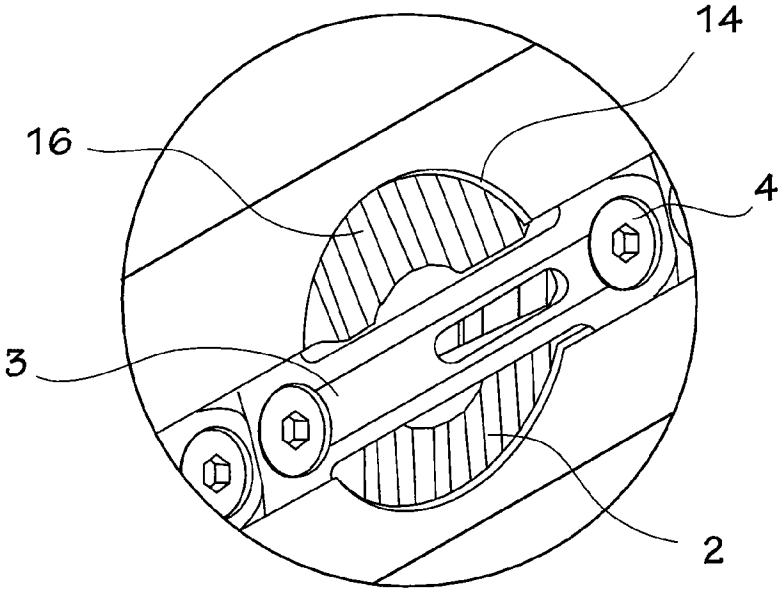

Illustrated in FIG. 3 is another embodiment of the present invention. This embodiment is purely mechanical, and does not require hydraulic pressure to set or release the engagement members, in this instance, slips 30, from the casing or wellbore wall. The anchor is connected to a work string, such as coiled tubing, by threads 32 on the uphole side, and connected to downhole tools or other apparatus as desired by threads 33. The central portion of the anchor consists of mandrel 36, which carries a taper 38. The upper portion of the mandrel 36 has a J slot mechanism 40, which is well known in downhole tools. Surrounding the mandrel 36 is a slip collar 42. Arranged circumferentially around the slip collar 42 are spring loaded drag blocks 44. The spring loaded drag blocks 44 contact the inside of the casing or wellbore and introduce a frictional force to partially arrest relative movement between the anchor assembly and the casing.

In other words, the housing 10 comprises the mandrel 36 along a central portion of the anchor 15 and is connected to the uphole and downhole end of the anchor. The slip collar 42 surrounds a portion of the mandrel 36; and the plurality of spring loaded drag blocks 44 are positioned circumferentially around the slip collar 42. The mandrel 36 is tapered at a position on the downhole side of the slip collar 42. The plurality of engagement members include slips 30 connected to the slip collar 42 and are positioned circumferentially around the housing on the uphole side of the taper of the mandrel 36; wherein to set the anchor 15, the spring loaded drag blocks 44 hold the slip collar 42 stationary relative to the mandrel 36 allowing the mandrel to slide upwards against the slips, forcing the slips radially outwards to engage the wall of the casing or wellbore. The J slot mechanism is positioned on the upper portion of the mandrel 36 to set and release the slips 30.

When it is desired to set the anchor, it is run into the hole to the desired position. The outward force generated by the spring loaded drag blocks 44 will hold the slip collar 42 stationary relative to the casing, and the coiled tubing is then lifted upward a small amount, usually between 6 to 12 inches. As the mandrel 36 is attached to the coiled tubing by threads 32, it is displaced to the left as shown in FIG. 3, and the taper 38 engages the mating taper on the inner surface of the slips 30, thus forcing them radially outward and into contact with the casing wall. The teeth on the face of the slips 30 then "bite" into the casing and prevent any further relative motion of the anchor relative to the casing. When it is desired to release the anchor, the mandrel 36 is displaced downward slightly, and the J slot mechanism 40 allows the mandrel to move to the right in FIG. 3, releasing the slips 30 from their engagement with the taper 38 and allowing them to move radially inward. This allows the slips to disengage from the casing wall, and allow the slip collar 42 to be held stationary only by the drag blocks 44. The force exerted by the drag blocks is only sufficient to hold the slip collar 42 stationary for the purposes of actuating the J slot mechanism 40 to set and release the slips, it is not sufficient to prevent the anchor assembly from moving in and out of the hole.

What is claimed is:

1. A fracturing tool anchor adapted for use in a wellbore, the fracturing tool anchor comprising:

a housing having an uphole end, a downhole end, and a central passage between the uphole end and the downhole end;

a plurality of ports spaced circumferentially around the housing and/or spaced longitudinally along the length of the housing between the uphole end and the downhole end; and a plurality of pistons positioned within the plurality of ports and in fluid communication with the central passage, the plurality of pistons, upon application of pressure through the central passage, extending radially outwards through the plurality of ports to engage a wall of the wellbore or casing, wherein each port is counterbored having a large diameter bore facing the wellbore and a small diameter bore adjacent the large diameter bore, and each of the plurality of pistons has a large diameter portion fit to the large diameter bore and a small diameter portion fit to the small diameter bore.

2. The fracturing tool anchor according to claim 1, wherein an outward face of each of the plurality of pistons is serrated to firmly engage the wall of the wellbore or casing.

3. The fracturing tool anchor according to claim 1, wherein the fracturing tool anchor further comprises a spring retainer for returning the plurality of pistons to a rest position.

4. The fracturing tool anchor according to claim 3, wherein the uphole end and the downhole end of the housing are configured to attach a work string and other downhole tools, respectively.

5. The fracturing tool anchor according to claim 1, wherein the uphole end is adapted to connect to a work string and the downhole end is adapted to connect to downhole tools or other apparatuses.

6. The fracturing tool anchor of claim 1, wherein an annular shoulder is formed between the port's large and smaller diameter bores, a plurality of recesses being provided in the housing about the annular shoulder.

7. The fracturing tool anchor of claim 3 wherein the spring retainer extends longitudinally from the housing and across each of the plurality of pistons.

8. The fracturing tool anchor of claim 7 wherein an outward facing surface of each of the plurality of pistons is fit with a longitudinal slot aligned with the spring retainer.

9. The fracturing tool anchor of claim 7 wherein a return spring is fit between the spring retainer and each of the plurality of pistons.

10. The fracturing tool anchor of claim 9 wherein the return spring is fit into a pocket in the piston.

* * * * *